US011299945B2

(12) United States Patent
Warlick et al.

(10) Patent No.: US 11,299,945 B2
(45) Date of Patent: Apr. 12, 2022

(54) COUNTER AND SYSTEM WITH COUNTER

(71) Applicants: Geoffrey Warlick, Spring, TX (US); Sean Gaudette, Katy, TX (US); Bradley Kellogg, Houston, TX (US); Taylor Broussard, Houston, TX (US)

(72) Inventors: Geoffrey Warlick, Spring, TX (US); Sean Gaudette, Katy, TX (US); Bradley Kellogg, Houston, TX (US); Taylor Broussard, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/189,314

(22) Filed: Mar. 2, 2021

(65) Prior Publication Data

US 2021/0277734 A1 Sep. 9, 2021

Related U.S. Application Data

(60) Provisional application No. 62/984,663, filed on Mar. 3, 2020.

(51) Int. Cl.

| | |
|---|---|
| ***E21B 23/04*** | (2006.01) |
| ***F15B 15/22*** | (2006.01) |
| ***E21B 34/06*** | (2006.01) |

(52) U.S. Cl.

CPC ..... *E21B 23/0412* (2020.05); *E21B 23/042* (2020.05); *E21B 23/0415* (2020.05); *E21B 34/063* (2013.01); *F15B 15/226* (2013.01)

(58) Field of Classification Search

CPC ..... E21B 23/0412; E21B 23/042; E21B 23/0421; E21B 23/04

See application file for complete search history.

(56) References Cited

U.S. PATENT DOCUMENTS 5,375,662 A 12/1994 Echols, III et al.
10,428,609 B2 * 10/2019 Farrar ..... E21B 23/04
(Continued)

FOREIGN PATENT DOCUMENTS

EP 1073824 A1 2/2001
WO 2009098498 A1 8/2009

OTHER PUBLICATIONS

Notification of Transmittal of the International Search Report and the Written Opinion of the International Searching Authority, or the Declaration; PCT/US2021/020588; dated Jun. 18, 2021; 8 pages.

*Primary Examiner* — Shane Bomar

(74) *Attorney, Agent, or Firm* — Cantor Colburn LLP

(57) ABSTRACT

A counter including a housing disposed about a tubular creating a space therebetween, a piston disposed in the space and responsive to pressure up events in the tubular to compress a transfer chamber, a supply chamber fluidly attached to the transfer chamber; a trigger chamber fluidly attached to the transfer chamber wherein sequential pressure events cause the piston to move fluid from the supply chamber to the trigger chamber. A counter including a fluid incrementing configuration, an activation member in fluid force communication with the fluid incrementing configuration, the activation member having a first position where a fluid port is blocked and a second position where the fluid port is unblocked, the fluid port being fluid pressure connected to a tool to be actuated when the activation member is in the second position.

12 Claims, 4 Drawing Sheets

(56) References Cited

U.S. PATENT DOCUMENTS

| | | | | |
|---|---|---|---|---|
| 2014/0000908 | A1* | 1/2014 | Abdelall | E21B 23/04 166/373 |
| 2014/0299330 | A1 | 10/2014 | Fripp et al. | |
| 2018/0187501 | A1* | 7/2018 | van Petegem | E21B 41/00 |
| 2019/0012809 | A1 | 5/2019 | Woudwijk | |
| 2019/0195048 | A1* | 6/2019 | Tveranger | E21B 34/14 |
| 2020/0284123 | A1 | 9/2020 | Tveranger et al. | |

* cited by examiner

COUNTER AND SYSTEM WITH COUNTER

CROSS REFERENCE TO RELATED APPLICATIONS

This application claims the benefit of an earlier filing date from U.S. Provisional Application Ser. No. 62/984,663 filed Mar. 3, 2020, the entire disclosure of which is incorporated herein by reference.

BACKGROUND

In the resource recovery industry it is sometimes desirable to allow pressure up events to occur prior to a pressure based actuation of one or more tools occurs. There are counter mechanisms available in the art such as J slots and metering devices that can be used to effect this result. These devices and methods related thereto are useful in some situations but particularly in the hydrocarbon recovery industry circumstances are varied and the art is often in need of different configurations to address particular needs. For this reason, the art is always receptive to innovations that increase the options available.

SUMMARY

An embodiment of a counter including a housing disposed about a tubular creating a space therebetween, a piston disposed in the space and responsive to pressure up events in the tubular to compress a transfer chamber, a supply chamber fluidly attached to the transfer chamber; a trigger chamber fluidly attached to the transfer chamber wherein sequential pressure events cause the piston to move fluid from the supply chamber to the trigger chamber.

An embodiment of a counter including a fluid incrementing configuration, an activation member in fluid force communication with the fluid incrementing configuration, the activation member having a first position where a fluid port is blocked and a second position where the fluid port is unblocked, the fluid port being fluid pressure connected to a tool to be actuated when the activation member is in the second position.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
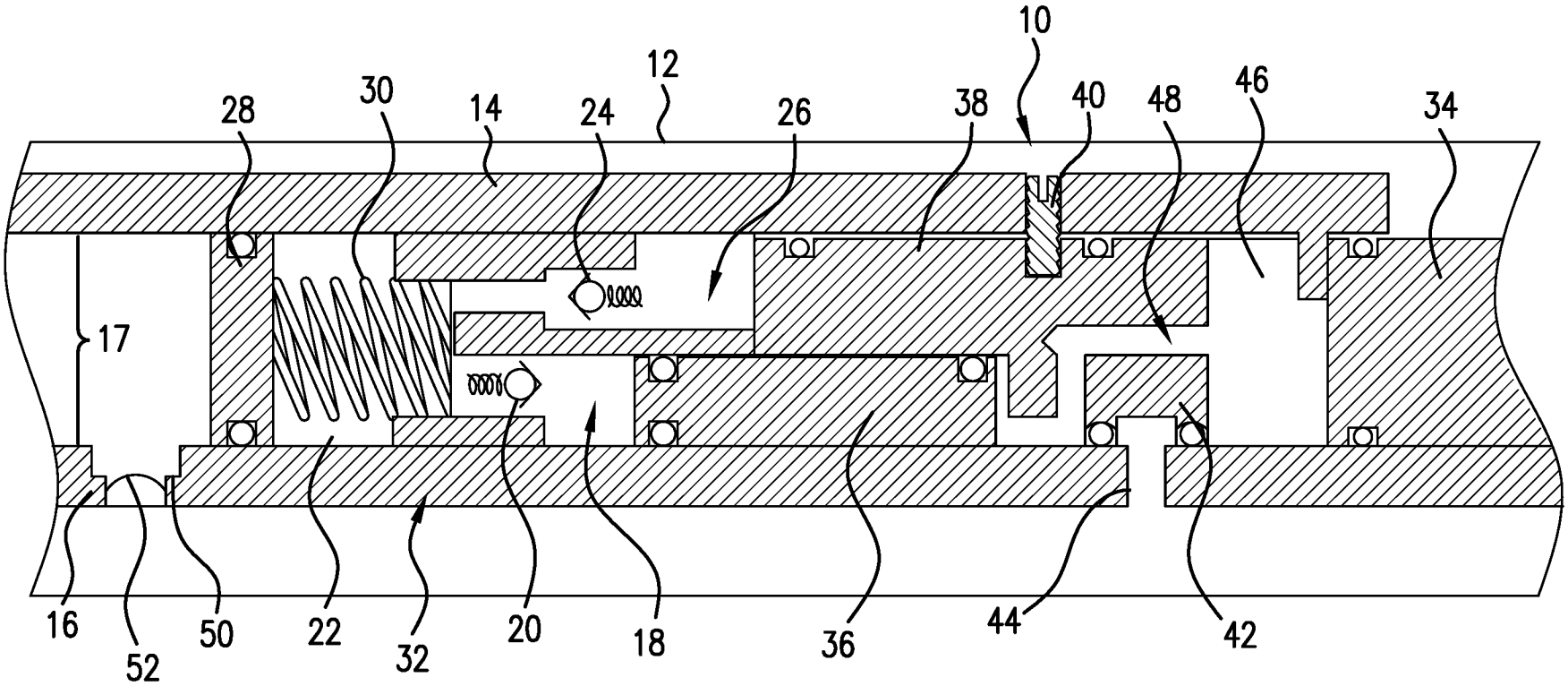
FIG. 1 is a schematic cross section view of a hydraulic counter as disclosed herein in an initial position.
Figure 2:
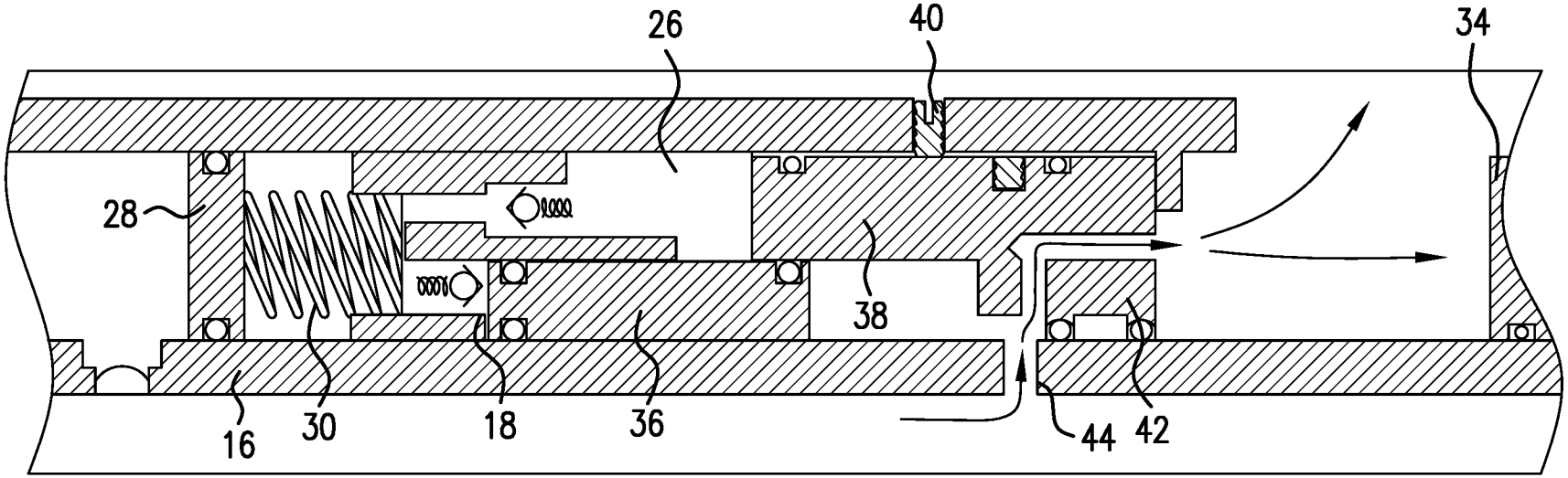
FIG. 2 is the hydraulic counter of FIG. 1 in an actuation position.

Hydraulic counters as disclosed herein utilized pressure up events in a downhole environment to create hydraulic changes within the counter that after a selected number of pressure events result in an actuation event for an attached tool. It will be appreciated by those of skill in the art that a pressure up event is created by pumping fluid at a surface location into a borehole to raise the fluid pressure in the borehole to something above static pressure of the fluid column. Pressure up events can be from a few pounds to thousands of pounds of pressure. Pressure up events are often used for actuating tools in the downhole environment but they are also often used for testing. When testing is to be undertaken, it is useful for an operator to have a counter device in place that allows the preliminary testing pressure up events to occur while not yet actuating one or more tools. Referring to FIGS. 1 and 2 simultaneously, an embodiment of a hydraulic counter 10 is illustrated in an initial position (FIG. 1) prior to being subjected to pressure up events. In FIG. 2, the counter 10 is illustrated in a position where actuation of an attached tool is permitted. Referring specifically to FIG. 1, the counter 10 is shown in a portion of a borehole 12. The counter 10 includes a housing 14 that together with a tubing segment 16 defines a space 17 therebetween in which a number of hydraulic components are disposed. The counter 10 includes a supply chamber 18. The chamber 18 may be filled with any incompressible fluid such as hydraulic oil. The chamber 18 is connected via a check valve 20 to a transfer chamber 22. The transfer chamber 22 is connected via a check valve 24 to a trigger chamber 26. The transfer chamber comprises a piston 28 and a biasing member 30. Together, chamber 18, valve 20, chamber 22, piston 28, member 30, valve 24, and chamber 26 create a fluid incrementing configuration collectively identified as numeral 32. For each pressure up event that reaches piston 28, biasing member 30 is compressed and fluid in transfer chamber 22 is forced through valve 24 into trigger chamber 26. Upon release of a pressure up event that reaches piston 28, the biasing member 30 will reset the piston 28 and thereby draw fluid from supply chamber 18 into transfer chamber 22 such that the sequence just described can be performed again. For clarity purposes, the sequence will be called a charging sequence herein. The counter 10 may be adjusted to undergo a particular number of charging sequences before the counter will enable actuation of an attached tool 34.

Still referring to FIG. 1, several other components of the counter 10 are identified. In order to allow fluid in the supply chamber 18 to exit that chamber, the volume of the chamber is changeable through movement of float 36. For each charging sequence, the float 36 will move toward the check valve 20 as a function of pressure reduction in the supply chamber 18 due to a lower pressure created in transfer chamber 22 by biasing member 30. Charging sequences each increase pressure in the trigger chamber 26 until a threshold pressure is achieved where an activation member 38 experiences enough differential pressure across itself that a release member 40 releases the activation member 38. The release member may be a shear screw as shown or any other configuration for holding a component in place until a threshold force is reached as will be familiar to those of skill in the art.

It will be appreciated that in the embodiment of FIGS. 1 and 2, the activation member 38 includes a portion thereof 42 that closes a port 44 in the tubular 16, that port accessing inside diameter (ID) tubing pressure. Upon activation member 38 activating, the portion 42 opens the port 44 and tubing pressure is transferred through the port 44 to an actuation chamber 46 through access channel 48 such that tubing pressure may at this stage act on the tool 34 and effect actuation thereof. This is shown in FIG. 2 with arrows indicating fluid flow.

Charging sequences are begun with tubing pressure applied to the piston 28 through port 50, which may in embodiments include an initial closure member 52 such as a rupture disk 52 or similar. This will allow determination of a first threshold pressure up condition before the counter 10 begins charging sequences. By stacking several of the counters 10 along a borehole system having different first threshold pressure requirements before charging sequences will begin, greater control and sequencing of the actuation of tools may be achieved.

Figure 3:
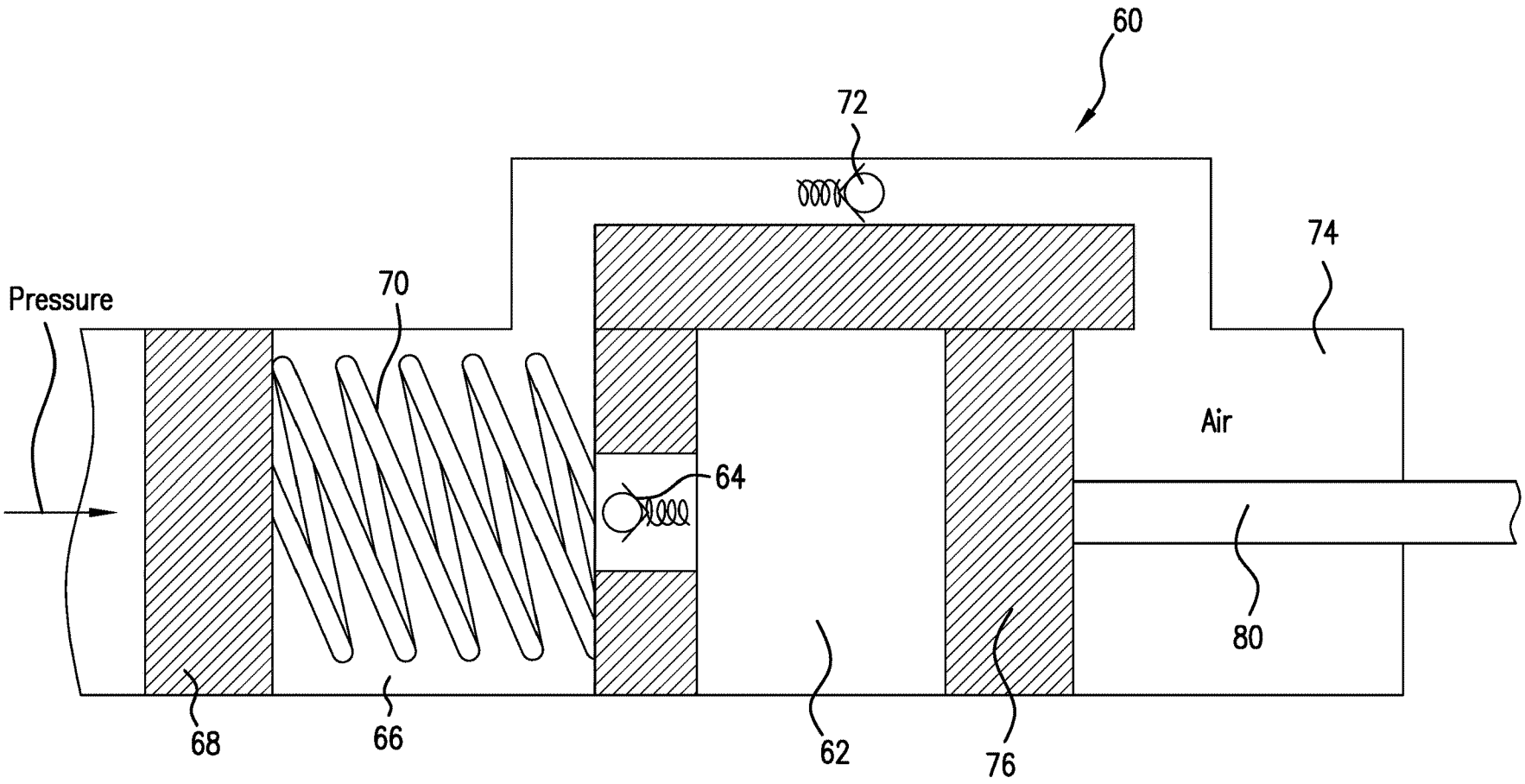
FIG. 3 is an alternate embodiment of a hydraulic counter as disclosed herein.

In another embodiment, referring to FIG. 3, a counter 60 is illustrated schematically. It will be appreciated that the counter 60 would be installed similarly to the embodiment shown in FIG. 1. In this embodiment a supply chamber 62 again contains an incompressible fluid such as hydraulic fluid or similar. The supply chamber 62 is connected through check valve 64 to a transfer chamber 66 that similar to the FIG. 1 embodiment includes a piston 68 and a biasing member 70. Transfer chamber 66 is connected through check valve 72 to a trigger chamber 74. It is important that the trigger chamber in this embodiment includes a compressible fluid such as air therein since the compression and expansion of that compressible fluid is integral to the function of the counter 60. Finally an actuation piston 76 is interactive with the trigger chamber 74 and the supply chamber 62.

Upon pressure up events, piston 68 is urged toward the supply chamber 62 compressing biasing member 70 and expelling fluid in transfer chamber 66 through check valve 72 into trigger chamber 74. Upon release of the pressure up event, the biasing member 70 extends, resetting the piston 68 and drawing fluid from the supply chamber 62 through the check valve 64 into the transfer chamber 66. This is analogous to the charging sequence discussed above. The sequence is repeated for a selected number of times after which a tool 80 may actuate. Tool 80 may be directly mechanically actuated or may be actuated by another pressure event similar to the embodiment of FIG. 1. It was noted above that a compressible fluid in trigger chamber 74 is important. This is because without a compressible fluid therein, the counter 60 will hydraulically lock itself. The compressible fluid allows movement of the components of the counter 60 without hydraulically locking.

Figure 4:
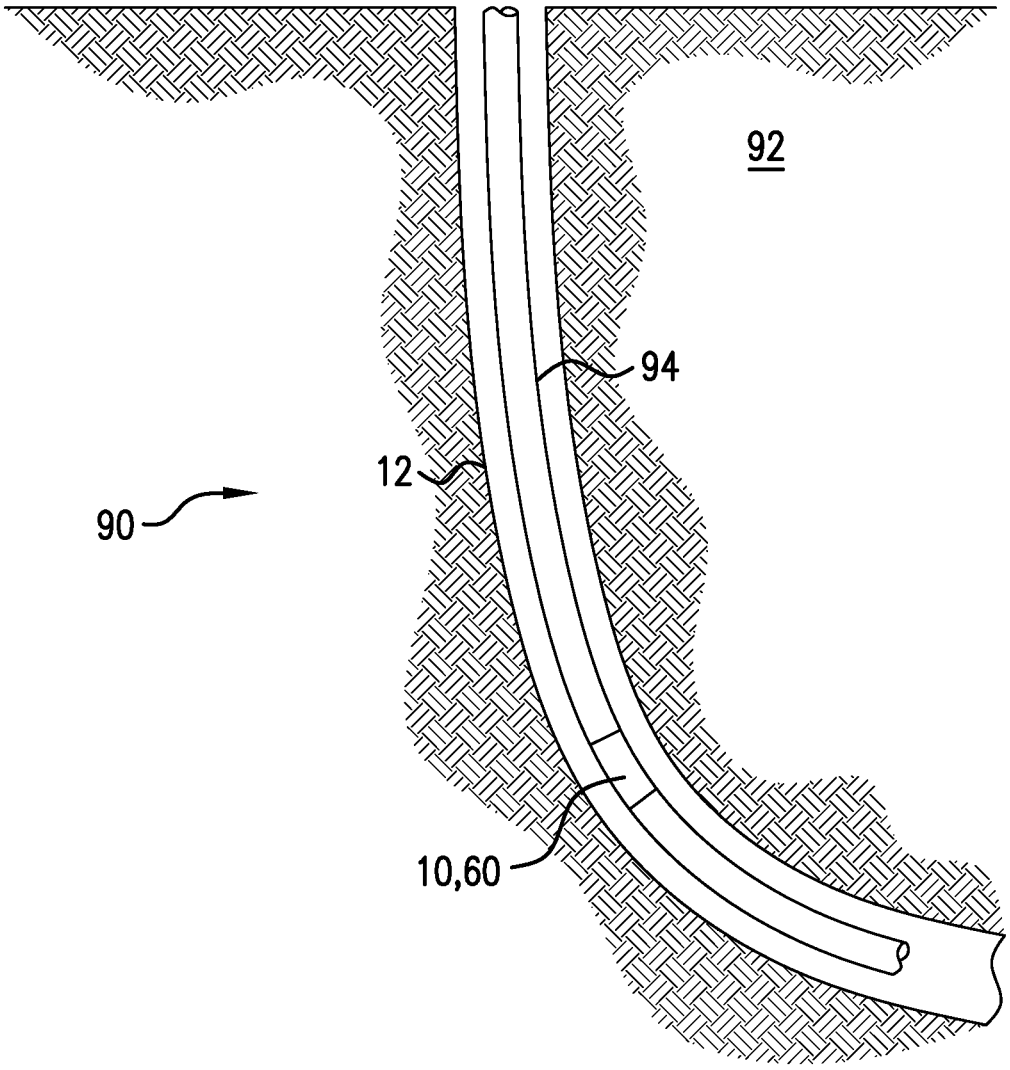
FIG. 4 is a schematic view of a borehole system with a counter therein.

Referring to FIG. 4, a schematic illustration of a wellbore system 90 is illustrated. A borehole 12 in a formation 92 includes a string 94 therein. The string 94 includes one or more counters 10, 60 so that actuation of attached tools (not shown) can be effected after a selected number of pressure up events in the borehole. This provides great benefit to the art since testing operations may be carried out and pressure held for indefinite periods without unintentionally actuating tools attached to the counter(s).

Set forth below are some embodiments of the foregoing disclosure:

Embodiment 1: A counter including a housing disposed about a tubular creating a space therebetween, a piston disposed in the space and responsive to pressure up events in the tubular to compress a transfer chamber, a supply chamber fluidly attached to the transfer chamber; a trigger chamber fluidly attached to the transfer chamber wherein sequential pressure events cause the piston to move fluid from the supply chamber to the trigger chamber.

Embodiment 2: The counter as in any prior embodiment further including check valves between the supply chamber and the transfer chamber and between the transfer chamber and the trigger chamber and wherein the check valves allow fluid flow only from the supply chamber to the transfer chamber and from the transfer chamber to the trigger chamber.

Embodiment 3: The counter as in any prior embodiment further including a biasing member that resets the piston upon release of the pressure up event.

Embodiment 4: The counter as in any prior embodiment further including an activation member.

Embodiment 5: The counter as in any prior embodiment wherein the activation member is releasably connected to the housing.

Embodiment 6: The counter as in any prior embodiment wherein the release member releases at a selected force based upon pressure in the trigger chamber.

Embodiment 7: The counter as in any prior embodiment wherein the activation member includes a portion that obstructs a port in the tubular, the portion moving when the release member releases, thereby allowing fluid access to the tubular through the port Embodiment 8: The counter as in any prior embodiment wherein the trigger chamber contains an incompressible fluid.

Embodiment 9: The counter as in any prior embodiment wherein the trigger chamber contains a compressible fluid.

Embodiment 10: The counter as in any prior embodiment further including an actuation piston interactive with the trigger chamber and the supply chamber.

Embodiment 11: A counter including a fluid incrementing configuration, an activation member in fluid force communication with the fluid incrementing configuration, the activation member having a first position where a fluid port is blocked and a second position where the fluid port is unblocked, the fluid port being fluid pressure connected to a tool to be actuated when the activation member is in the second position.

Embodiment 12: A borehole system including a borehole in a subsurface formation, a string in the borehole, a counter as in any prior embodiment disposed in the string.

Embodiment 13: A method for operating a borehole system including pressuring on the borehole system, counting pressurization events with the counter as in any prior embodiment, actuating a downhole tool upon the counter generating a threshold actuation pressure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A counter comprising:

a housing disposed about a tubular creating a space therebetween;

a piston disposed in the space and responsive to pressure up events in the tubular to compress a transfer chamber;

a supply chamber fluidly attached to the transfer chamber;

a trigger chamber fluidly attached to the transfer chamber wherein sequential pressure events cause the piston to move fluid from the supply chamber to the trigger chamber.

2. The counter as claimed in claim 1 further including check valves between the supply chamber and the transfer chamber and between the transfer chamber and the trigger chamber and wherein the check valves allow fluid flow only from the supply chamber to the transfer chamber and from the transfer chamber to the trigger chamber.

3. The counter as claimed in claim 1 further including a biasing member that resets the piston upon release of the pressure up event.

4. The counter as claimed in claim 1 further including an activation member.

5. The counter as claimed in claim 4 wherein the activation member is releasably connected to the housing by a release member.

6. The counter as claimed in claim 5 wherein the release member releases at a selected force based upon pressure in the trigger chamber.

7. The counter as claimed in claim 6 wherein the activation member includes a portion that obstructs a port in the tubular, the portion moving when the release member releases, thereby allowing fluid access to the tubular through the port.

8. The counter as claimed in claim 1 wherein the trigger chamber contains an incompressible fluid.

9. The counter as claimed in claim 1 wherein the trigger chamber contains a compressible fluid.

10. The counter as claimed in claim 1 further including an actuation piston interactive with the trigger chamber and the supply chamber.

11. A borehole system comprising:

a borehole in a subsurface formation;

a string in the borehole;

a counter as claimed in claim 1 disposed in the string.

12. A method for operating a borehole system comprising:

pressuring on the borehole system;

counting pressurization events with the counter as claimed in claim 1;

actuating a downhole tool upon the counter generating a threshold actuation pressure.

* * * * *